US007041250B2

(12) United States Patent
Sherman et al.

(10) Patent No.: US 7,041,250 B2
(45) Date of Patent: May 9, 2006

(54) COMBINED LIQUID PHASE AND ACTIVATED SINTERING OF REFRACTORY METALS

(75) Inventors: Andrew J. Sherman, Granada Hills, CA (US); Asit Biswas, Studio City, CA (US)

(73) Assignee: Powdermet, Inc., Euclid, OH (US)

( * ) Notice: Subject to any disclaimer, the term of this patent is extended or adjusted under 35 U.S.C. 154(b) by 169 days.

(21) Appl. No.: 10/227,142

(22) Filed: Aug. 22, 2002

(65) Prior Publication Data

US 2003/0039573 A1 Feb. 27, 2003

Related U.S. Application Data

(60) Provisional application No. 60/314,755, filed on Aug. 23, 2001.

(51) Int. Cl.
*B22F 3/00* (2006.01)

(52) U.S. Cl. ..... 419/47; 75/245

(58) Field of Classification Search ..... 419/47, 419/53; 75/53, 245
See application file for complete search history.

(56) References Cited

U.S. PATENT DOCUMENTS 3,650,736 A * 3/1972 Broom ..... 419/37
4,743,512 A * 5/1988 Marlowe et al. ..... 428/552
5,114,469 A * 5/1992 Weiman ..... 75/235
5,545,323 A 8/1996 Koehler et al.
5,603,073 A * 2/1997 Bose ..... 419/57
5,824,923 A 10/1998 Kondoh et al.
5,950,064 A * 9/1999 Robinson et al. ..... 419/47

* cited by examiner

*Primary Examiner*—Ngoclan T. Mai
(74) *Attorney, Agent, or Firm*—Bruce A. Jagger

(57) ABSTRACT

A process for producing a binder phase free fine grained refractory metal compact at temperatures that are less than about 80 percent of the melting point of the refractory metal. A refractory metal is mixed with a metallic reagent to produce a mixture with a low melting point, and formed into a preform. The metallic reagent has limited solubility in the solid phase refractory metal. The refractory metal-metallic reagent mixture forms a liquid phase at the boundaries of the refractory metal grains. The metallic reagent diffuses into the boundaries of the refractory grains leaving a solid refractory-reagent phase at the boundaries between the grains. As heating continues at less than about 80 percent of the melting point of the refractory metal, consolidation takes place with minimum grain growth until the solid refractory-reagent phase substantially disappears and a refractory metal compact without a binder phase is recovered. If the refractory metal-metallic reagent preform is compacted to less than about 50 percent of theoretical density, it is possible to recover a microporous compact. At higher compaction rates substantially fully dense compacts are recovered. It is not necessary to apply pressure during the sintering phase.

7 Claims, No Drawings

COMBINED LIQUID PHASE AND ACTIVATED SINTERING OF REFRACTORY METALS

RELATED APPLICATIONS

This application claims the benefit of U.S. Provisional application Ser. No. 60/314,755, filed Aug. 23, 2001.

The U.S. Government has a paid-up license in this invention and the right in limited circumstances to require the patent owner to license others on reasonable terms as provided for by the terms of contract No. N00014-99-C-0619 awarded by the Navy.

BACKGROUND OF THE INVENTION

1. Field of the Invention

The invention relates in general to refractory metal compacts and their preparation, and, in particular, to the inexpensive low temperature sintering of refractory metal compacts that are of a desired density, up to and including substantially fully dense, and exhibit high refractory grain contiguity.

2. Description of the Prior Art

The low temperature sintering of refractory metal compacts had generally been considered to be impossible or impractical. It is well recognized in the art that various methods of sintering are available to form sintered metal compacts from powdered materials. Some of these prior methods had generally been considered to be unsuitable for use with refractory metals. Some problems that were typically encountered in processing refractory metals included excessive grain growth, low contiguity, low melting matrix phases, an inability to achieve substantially full theoretical densities, and high processing costs.

Liquid phase sintering, according to the teachings of the conventional prior art, generally involved selecting a base metal-additive combination wherein the additive exhibited a high solubility for the base metal, but a low solubility in the base metal. A liquid base metal-additive phase formed at a liquid phase sintering temperature below the melting point of the base metal. Sufficient additive was provided to form a liquid phase consisting of additive and base metal. Because the additive did not dissolve to any significant degree into the base metal, the liquid phase was permanent. Upon cooling the resulting prior art compacts generally contained a solid base metal phase and a solid phase at the grain boundaries that corresponded to the composition of the liquid phase. The production of two or more solid phases was generally an unavoidable artifact of the prior art liquid phase sintering processes. The presence of such a low melting, and usually low strength, solidified liquid phase (matrix or binder) is generally undesirable in most refractory metal compacts.

The sintering of refractory metals was generally believed to inevitably result in substantial grain growth. Grain growth is a function of surface area. The amount of grain growth increases with increasing surface area, and surface area increases as the average diameter of the particle decreases. Thus, the smaller the grain, the more grain growth will occur. With many prior refractory metal sintering processes it did not matter much what the initial grain size was, the grains would grow to about the same size in the finished compact. Grain growth is undesirable, because the properties of the compact generally improve as the grain size decreases.

Activated solid phase sintering, according to the teachings of the conventional prior art, generally involved selecting a base metal-additive combination wherein the additive exhibited a high solubility for the base metal, but a low solubility in the base metal. In this respect the prior activated solid phase sintering process was similar to the prior liquid phase sintering process. The quantity of the additive, however, was generally insufficient to form a significant liquid phase, for example, less than about 0.3 percent by weight of the total mixture. The additive remained at the interfaces between the refractory metal grains where it served to activate the sintering operation. Upon cooling the additive was still present at the grain interfaces. Because the additive was selected to be substantially insoluble in the base metal, it could not migrate into the base metal. Grain contiguity was thus seriously impaired. For most refractory metal applications this resulted in degraded physical properties as compared to compacts with high grain contiguity. Activated sintering generally proceeded more slowly than liquid phase sintering. During processing the compact was held at elevated temperatures for a considerable period of time. With refractory metals this generally resulted in substantial grain growth. Also, additional processing steps, such as pressurizing the compact, and the like, were generally required to achieve substantially full density. These additional processing steps complicated the process and increased the expense.

Transient liquid phase sintering, according to the teachings of the conventional prior art, generally involved selecting a base metal-additive combination wherein the additive formed a liquid with the base metal, and also exhibited a high solid solubility in the base metal. During the process of sintering, a liquid phase was formed. This liquid phase then rather quickly disappeared and liquid aided sintering ceased, because the additive dissolved into the solid phase base metal. The liquid phase did not solidify into a second matrix phase, rather, it simply disappeared as the additive dissolved into and alloyed with the base metal. When the system cooled there was no detectable solid phase corresponding to the liquid phase. High grain contiguity was generally achieved. With refractory metals it had generally been considered impossible to achieve substantially full theoretical density with transient liquid phase sintering alone. A high temperature and/or high pressure step was generally believed necessary to achieve full density. Final densification required solid state diffusion at temperatures close to the melting point of the refractory metal for long periods of time. The properties of the final refractory metal compact were primarily determined by the high temperature conditions in the final densification step. Grain growth was generally limited in transient liquid phase sintering operations because the compact was held at the sintering temperature for only a relatively short period of time. Unfortunately, substantial grain growth occurred in the final high temperature, densification step, so no significant advantages were realized from the use of transient liquid phase sintering with refractory metals.

Previously it had been believed that it was not possible to achieve both transient liquid sintering and activated sintering with the same system. Transient liquid sintering was generally believed to require an additive with high solubility in the base metal. Activated sintering, by contrast, was known to require an additive with low solubility in the base metal. These two requirements were previously believed to be incompatible with one another.

Applicant has discovered how to hold an effective amount of a metallic reagent at the boundaries between refractory metal grains long enough for the metallic reagent to activate the sintering of the refractory metal grains in a compact. As the compact reaches substantially full density the metallic reagent diffuses away from the boundaries into the refractory grains.

These and other difficulties of the prior art have been overcome according to the present invention.

BRIEF SUMMARY OF THE INVENTION

According to the present invention it is possible to enjoy the benefits of simple and inexpensive low temperature pressureless processing, minimal grain growth, and up to and including substantially full theoretical density in a near net-shape, single phase refractory metal compact with high grain contiguity. These benefits are achieved by selecting combinations and proportions of refractory metals and metallic reagents with particular predetermined properties, and processing them under conditions whereby effective consolidation occurs at temperatures substantially below the melting point of the refractory metals. The reagents substantially all diffuse into the refractory metals by about the time the objective of the process is achieved. Very high grain contiguity is achieved without significant grain growth. Both transient liquid phase sintering and activated solid phase sintering are believed to be involved. The present invention is particularly suited to the formation of fine grained refractory metal compacts from powdered materials.

The refractory metals and metallic reagents, respectively, are first selected from those combinations wherein a liquid phase of the refractory metals and metallic reagents will form at temperatures well below the melting points of the refractory metals. Those mixtures that form low melting eutectics are particularly preferred. Various mixtures, alloyed, blended, or otherwise mixed, of the refractory metals, as well as mixtures, alloyed, blended, or otherwise mixed, of the metallic reagents can be selected to achieve the desired characteristics in the refractory metal-metallic reagent combined mixture. Particularly low melting points are achieved, for example, through the use of materials that form eutectics. The refractory metal grains are coated with, blended with, or otherwise intimately mixed with the metallic reagents to form an intimate mixture that is subsequently formed into a compact pre-form. Typically the pre-form is formed by the application of cold pressure. Some compaction is achieved at this stage. To some extent, the final density of the compact is determined by the degree of cold compaction. The compact pre-form is then processed according to the present invention to form a single phase refractory metal compact. A substantially fully dense refractory metal compact can be achieved, if desired. Porous compacts can also be achieved, if desired, by using loosely compacted pre-forms.

The next selection criterion for the combination of the refractory metals and metallic reagents is that the metallic reagents must enjoy only limited solubility in the solid phase refractory metals at approximately the temperatures where transient liquid phase sintering is carried out. The solubility of the metallic reagents in the solid phase refractory metals, and the use of proportionally small amounts of the metallic reagents, assures that the liquid phase will be transient even under isothermal conditions. As soon as enough of the metallic reagents diffuse into the solid phase refractory metal grains the liquid phase disappears and the whole system becomes substantially solid.

When the transient liquid phase sintering stage has progressed to the point where the liquid phase is substantially gone, there is still a residue of the metallic reagents left at the boundaries between the refractory metal grains. This residue has not diffused into the refractory metals because of the limited solubility of the metallic reagents in the refractory metals. This residue acts as a formed in situ activated sintering aid for solid phase sintering of the refractory metal grains. The peripheral portions of the refractory metal grains are substantially saturated with metallic reagent, but there is no visible separate phase. That is, there is a thin shell of metallic reactant and refractory metal alloy within the periphery of the individual grains, but this alloy shell does not appear as a separate phase. If the peripheries of the refractory metal grains were not substantially saturated, the residue would quickly diffuse into the peripheral portions of the grains and away from the grain boundaries, and solid phase sintering would stop. This would be undesirable because the compact would not be completely densified.

Unlike conventional particle consolidation operations where activated sintering aids are employed, the activated sintering aids according to the present invention are primarily prevented from diffusing into the metal grains by the presence of the previously infused metallic reagent in the periphery of the grains, and not by their own inherent inability to diffuse into the grains. Indeed, the metallic reagents according to the present invention are selected so their residues will function as formed in situ activated sintering aids until the compact pre-form is substantially fully dense, and then diffuse into the peripheries of the refractory metal grains. An effective amount of residue is held at the grain boundaries for the required period of time by the presence of the previously infused metallic reagent, and then disappears into the refractory metal grains.

If the residue were left at the refractory metal grain boundaries it would impair the properties of the resulting compacts by reducing grain contiguity. At the conclusion of the transient liquid sintering phase the compacts are generally substantially less than fully dense (less than about 95, and generally less than approximately 85 percent of theoretical density). The selection of materials so that the residue has the necessary properties to enable substantially full densification without significant grain growth is critical. As heating of the compact pre-form is continued, the metallic reactant in the periphery of the refractory metal grain migrates inwardly. As the concentration of the previously infused metallic reagent in the periphery of the refractory metal grains drops, the residue diffuses into the periphery and away from the grain boundaries. During this process the thickness of the alloy shell apparently increases somewhat.

The selection of the refractory metals and metallic reagents is further restricted to those combinations of refractory metals and metallic reagents wherein the residue of the metallic reagents at the grain boundaries will activate the solid phase sintering of the refractory metals at temperatures well below the melting points of the refractory metals. The residue must be effective to activate low temperature solid phase sintering of the refractory metals so as to effect substantially full densification of the compact with very minimal grain growth. The refractory metal grains in the resulting compact enjoy nearly complete contiguity, and the compact is substantially fully densified. No further densification is required, or even possible.

The combination of refractory metals and metallic reagents is proportioned so as to take advantage of the limited solubility of the metallic reagents in the refractory metals at the low sintering temperatures that are employed. There must be sufficient metallic reagent to effect transient liquid phase sintering and provide an effective amount of the metallic reagent residue at the grain boundaries for purposes of activating a solid phase sintering stage. The amount of metallic reagent is, however, limited so that substantially all of the metallic reagent residue will diffuse into the refractory metal during, and, if necessary, following the activated sintering stage. Such continued heating is generally not preferred because of the risk of excessive grain growth. An effective amount of the metallic reagent residue should be held at the grain boundaries until the compact reaches better than 96, and preferably 99, percent of theoretical density (substantially full density).

By balancing solubility, temperature, and proportions, a transient liquid sintering phase occurs, a solid phase activated sintering aid is formed in situ, activated solid phase sintering is achieved, and the activated sintering aid effectively disappears from the grain boundaries as full density is achieved. This is accomplished without applying high pressures to the compact during sintering, or using any other expensive expedients. Minimal grain growth is experienced because the processing temperatures, particularly when the materials form low melting eutectics, are well below the melting point of the refractory. The processing temperatures are also preferably below the temperature at which inter-grain diffusion occurs between refractory grains. Inter-grain diffusion often occurs at approximately 75 percent of the refractory melting point.

The division of the description and definition of the present invention into transient liquid phase sintering, activated sintering and final diffusion phases is somewhat arbitrary, and is utilized for the purposes of ease of description and definition. Diffusion clearly occurs during the process because substantially all of the metallic reagent ends up dissolved in the refractory metal at the end of the process. Clearly, sintering takes place because the compact is formed and reaches nearly full theoretical density with minimal grain growth. Also, the resulting compact exhibits high grain contiguity. The operating temperatures are too low for solid phase diffusion between adjacent grains of refractory metals, and no substantial pressure is applied to the compact during the heating phase. The occurrence of successive transient liquid phase sintering, activated solid phase sintering, and final diffusion of the sintering aid into the grains is consistent with these observations.

In general, it is believed, without being bound by any theory, that the transition from liquid phase sintering to activated solid phase sintering is gradual. During this transition both types of sintering are probably occurring. The exact point at which liquid phase sintering ceases would probably be difficult, if not impossible, to determine. Likewise, the final stages of the diffusion of the residue away from the grain boundaries are probably reflected in a decrease in the rate of activated solid phase sintering, rather than an abrupt transition from sintering to non-sintering. It is believed that by the conclusion of the liquid phase sintering step the refractory metal grains at their boundaries are probably about fully saturated with metallic reagents. This is believed to substantially slow the rate at which the residue of the metallic reagents diffuses away from the boundaries. At this stage, the rate of the diffusion of the metallic reagents away from the boundaries is believed to be controlled by the rate at which the metallic reagents diffuse within the refractory metals and away from the boundaries. This intra-refractory metal diffusion reduces the concentration of the metallic reagent adjacent to the boundaries to a level below the solid solubility limit, but it generally proceeds relatively slowly. This slow intra-refractory metal diffusion allows the metallic reagent residues to remain at the boundaries long enough to activate the final activated sintering step, so the compact achieves substantially full theoretical density. This also allows the residues to substantially completely diffuse into the refractory metals shortly after or approximately concurrently with the achievement of substantially full densification. Without the initial substantial saturation of the outer periphery of the refractory metal grains, the metallic reagent residue would not remain at the boundaries between the grains long enough to effect densification. The selection and proportioning of materials as well as the selection and control of the operating temperatures must be made with this fact in mind. Operating temperatures that are too high at any stage will permit the residue to diffuse into the refractory metal too fast, as well as promoting grain growth. When these parameters are selected in accordance with the teachings of the present invention, the resulting grain boundaries are left free of residue, and there is a high degree of contiguity between adjacent grains.

To insure that the maximum possible contiguity is reached it may be desirable to adjust the parameters so that heating to drive the last of the residues from the grain boundaries needs to be continued for a short period of time after the maximum density is reached. Preferably, however, the metallic reagent is allowed to diffuse into the refractory at such a rate that the compact reaches substantially full density at approximately the same time the residue has substantially all diffused into the refractory. High grain contiguity with minimum grain growth is thus achieved. If there is a significant excess of metallic reagent in the mixture, high grain contiguity can not be achieved. Large excesses of metallic reagent will produce a compact with a matrix phase corresponding to the liquid phase, as in conventional liquid phase sintering. If there is too little metallic reagent, the activated sintering phase will be starved for activator, and the compact can not be fully densified at the low temperature substantially pressure free conditions that are employed.

An observer outside of the furnace in which the heating takes place sees that a compact pre-form composed of a mixture with the characteristics and proportions as described and defined is formed, placed in the furnace, and heated at less than approximately 80 percent of the melting point of the refractory metal for a period of time, and a substantially fully dense refractory metal compact is recovered from the furnace. Analysis of the compact reveals that substantially all of the metallic reagents are within the refractory metal, and the compact is a substantially fully dense, single phase (no binder phase), high contiguity, fine grained, refractory metal body. By reason of various observations it is believed that transient liquid phase sintering, activated sintering and final diffusion all take place as described and defined, but applicant does not wish to be bound by any particular theory.

Little or no pressure need be applied to the compact during the sintering phase, although substantial pressure may be applied if desired. In general, the minimal advantages, if any, obtained by applying significant pressure during the sintering phase do not justify the added expense.

The present invention is also applicable to the production of porous compacts. The green compact pre-forms are generally compacted to a density of at least approximately 50 volume percent of theoretical before the sintering process is applied. Such green compacts can be sintered to substantially full density according to the present invention. If, however, green compact pre-forms are only compacted to approximately 45 volume percent or less of theoretical density, porous compacts can be made. Such porous compacts exhibit the same minimal grain growth, and are generally suitable, for example, to serve as very fine filters. Also, particle shape has some significant effect on porosity. For example, generally spherical particles tend to form substantially fully dense compacts, while generally dumbbell shaped particles tend to form porous compacts. Because grain growth is minimal, according to the present invention, porous compacts having an average pore size of less than about 10 microns can be produced. In general, the solubility of the metallic reagent in the refractory metal is preferably such that a minimal amount of metallic reagent is employed. The metallic reagent diffuses slowly into the refractory metal so both transient liquid phase and activated solid phase sintering occur, but the amount of metallic reagent is insufficient to form a substantially fully dense compact. Where a porous compact is desired, the pre-form is loosely compacted, and the proportions and/or solubilites are adjusted so that the activated sintering phase does not result in achieving substantially full density. In general, compacts with void volumes of from approximately 40 to 10 percent are easily produced according to the present invention. Nano-porous compacts that are very strong, and corrosion resistant, with substantially uniform pores of less than 10 microns in size can be produced according to the present invention. The ability to achieve a finished compact with minimal grain growth is of substantial importance in achieving small uniform pores of micron size.

Metallic reagents according to the present invention include individual metals and mixtures of two or more materials in alloyed or other form. The metallic reagents can be composed of two or more materials when, for example, such a mixture causes the temperature at which the transient liquid phase is formed to be significantly depressed as compared to that achieved by the use of either metallic reagent component by itself. Also, one component of the metallic reagent can exert an effect primarily in the transient liquid sintering stage while another acts primarily in the activated sintering stage. Substantially all of the metallic reagent components must dissolve into the refractory in order to achieve high grain contiguity. The metallic reagents can be intimately mixed with the refractory metals by, for example, depositing the metallic reagents on the refractory metals, blending separate particles of metallic reagent and refractory metal, or the like mechanical mixing. The phase diagrams for various mixtures of metals are well know and generally available. Those skilled in the art, once instructed in the present invention, can select appropriated combinations by consulting these published phase diagrams as well as other published data concerning these materials.

The metallic residue that is formed at the refractory metal grain boundaries at approximately the conclusion of the transient liquid sintering phase generally differs somewhat from the initial metallic reagent. The residue, for example, will generally include some of the refractory metal. If the residue is derived from a mixture of components, the proportions of the components in the residue will likely be different from those in the original mixture, because the components have different solid solubility limits and diffusion rates. For similar reasons, the composition of the residue at the grain boundaries can change during the activated sintering phase.

Utilizing relatively low sintering temperatures and short sintering cycles achieves the objective of minimal grain growth. The sintering temperatures are generally less than approximately 80 percent, and preferably less than approximately 70 percent, those of the melting points of the refractory metals that are being processed. Some refractory metal-metallic reagent combinations cooperate to allow sintering temperatures as low as 50 percent or even less of the melting point of the refractory metals. The sintering and diffusion temperatures should be selected to provide the maximum density and/or grain contiguity with minimum grain growth. This does not necessarily mean the lowest possible temperature should be used, because the resulting longer cycle time may cause excessive grain growth. The operating temperature can be varied or held constant during the process. The temperature during the activated sintering step can be the same, higher, or lower than that employed during the transient liquid phase sintering step, and that employed during the final diffusion step can be the same or different from that in any of the prior steps. Grain growth generally becomes excessive if any of the operating temperatures exceeds about 80, and preferably about 70, percent of the melting point of the refractory metal. In any event, the processing temperature should preferably be below the temperature at which solid phase diffusion occurs between adjacent grains of refractory metal. Sudden temperature spikes that are quickly controlled do not generally result in excessive grain growth. The present invention contemplates and encompasses some necessary tolerance in the precision with which temperatures need to be controlled. Such tolerances in these and other operating parameters permit some significant reductions in operating and equipment costs as compared with conventional sintering processes.

The compacts that are produced according to the present invention are composed substantially entirely of single phase refractory metals. In this context "single phase" means that there is substantially no matrix phase. There may, however, be more than one refractory metal phase, and there may be inclusion phases. These are encompassed within the meaning of "single phase" as this phrase is applied to the refractory metal phase. It is usually impossible to achieve 100 percent conversion of the starting mixture to a "single phase" refractory metal, however, conversion rates in excess of about 96 to 99.5 percent are achievable, and the resulting compacts are considered to be composed of substantially a single phase. The completeness of the conversion is usually mostly a function of how thoroughly the raw ingredients were mixed. The use of refractory metal particles coated with the metallic reagent assures a very good physical mixture.

The benefits of the present invention are particularly beneficial when applied to refractory metal particles that are initially less than approximately 50, and preferably less than approximately 20 microns. The present invention can be applied to processing of larger particles, but the properties of the resulting compacts are generally not as good as those attained using smaller particle sizes. Theoretically, there is no lower limit to the size of the particles, however, as a practical matter, any advantages achieved by using particles of less than approximately 0.01 microns are generally offset by the added expense in making and handling the very fine particles. A preferred range in average particle size of from approximately 0.01 to 20 microns has been found to provide very good results. Larger particle sizes, just by reason of being bigger, generally do not generally provide compact properties that are as desirable. Smaller particles are generally difficult to make and handle, and tend to grow substantially during processing, so that they are ultimately no smaller than those that initially are substantially larger. Thus, the results achieved using particles that are less than about 0.01 microns are generally approximately the same as those achieved using larger particles. Some grain growth during sintering is inevitable, and it depends in part on the initial particle size. Grain growth for particles with an average size of about 1 micron is generally from 2 to 5 times the original particles size. For 10 micron particles the average grain growth is generally from about 1.2 to 1.5 times the original particle size. The advantageous physical characteristics afforded by small grain sizes are achieved according to the present invention. The average grain size of the refractory metal particles in the final compact is determined, for example, by optical microscopy or scanning electron microscopy.

The present invention is applicable to the production of compacts in which the grain size is deliberately larger than 20 microns. Conventional sintering operations generally experienced difficulty in achieving compacts wherein the grain sizes were larger than about 20 microns. In general, the physical properties of finer grained compacts are significantly better than those with grain sizes of 20 microns or larger, so there is generally no significant demand for larger grain sized compacts.

The term "contiguity" refers to the degree in which the refractory metal grains are in direct contact with one another in the final compact. The degree of contiguity is determined, for example, by optical microscopy or scanning electron microscopy. Contiguity of 100 percent is impossible to achieve, but a very high degree of contiguity (in excess of about 96 percent) is achievable according to the present invention.

A theoretical density of 100 percent would mean that there are no voids at all in the compact. It had previously been extremely difficult to achieve a theoretical density of 100 percent in refractory metal compacts formed from powdered refractory metals. It had generally been believed that extreme pressures and temperatures were necessary to achieve any density in excess of approximately 85 to 90 percent of theoretical. Such operating conditions are incompatible with limited grain growth, and they are very expensive to apply. According to the present invention substantially full densities of better than 96 to 99.5 percent of theoretical are easily achieved in refractory metal compacts at low temperatures without the application of significant pressure.

Other objects, advantages, and novel features of the present invention will become apparent from the following detailed description of the invention.

DETAILED DESCRIPTION OF THE PREFERRED EMBODIMENTS

The present invention provides its benefits across a broad spectrum of refractory metal powder metallurgy. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

In a preferred embodiment, which has been selected for purposes of illustration only and not limitation, a substantially fully dense, single phase rhenium compact with high grain contiguity was produced by selecting 93.8 weight percent of 200 mesh rhenium powder, with a melting point of about 3186 degrees centigrade, 2.2 weight percent of palladium powder, and 4 weight percent of cobalt powder. The solid solubility of palladium and cobalt in rhenium at 1475 degrees centigrade is limited. As reflected in previously published and widely available data, at 1475 degrees centigrade the Re-Pd-Co system forms a liquid phase. The rhenium, palladium and cobalt powders were mixed together for 4 hours to form an intimate unalloyed blend of about 1 to 10 micron Re—Co—Pd powders. The blended powders were then pressed into a predetermined shape using a cold isostatic pressing process to about 55 percent of theoretical density. The resulting green body pre-form was then placed in a conventional sintering furnace. A vacuum was applied, and the furnace was heated to about 1475 degrees centigrade (about 46 percent of the melting point of rhenium). The furnace was held at about 1475 degrees centigrade for about 2 hours. The furnace was then allowed to cool to room temperature. Upon examination, the recovered rhenium compact was found to have a single phase consisting of hexagonal closed packed rhenium grains with an average particle size of approximately 10 microns and a density greater than 99.5 percent of theoretical. The rhenium grains in the compact exhibited a high degree of contiguity. There was substantially no palladium or cobalt at the boundaries between the rhenium grains. Analysis of the compact indicated that the palladium and cobalt were alloyed with the rhenium. The compact was near net-shape. Only a little polishing was required to produce a finished part having the desired dimensions. Repetition of this experiment, but heating at about 1475 degrees centigrade for only about 10 minutes before cooling resulted in recovering a 2 phase compact in which a solidified liquid phase matrix was evident. The compact was determined to be less than 85 percent of theoretical density. Repetition of this experiment, but heating at about 1475 degrees centigrade for only about 1 hour before cooling resulted in recovering a compact in which the rhenium grains did not exhibit a high degree of contiguity. Analysis revealed that palladium and cobalt were present at the boundaries between the rhenium grains. It is apparent form these results that the final densification stage proceeds much more slowly than the other stages of sintering. This is where the most grain growth will likely occur unless the temperature is kept low.

Repetition of this process utilizing Ni and Ru in the metallic reagent will produce satisfactory results.

A tantalum sintered compact was prepared using 95 weight percent −325 mesh tantalum metal powder, 2 weight percent gold, and 3 weight percent cobalt. The 3 components of the compact were blended together in an attrition mill for about 2 hours to form an intimate unalloyed blend of Ta, Au and Co. The blended powder was cold isostatic pressed to form a green compact having a density of approximately 50 percent of theoretical. The green compact pre-form was placed into a vacuum sintering furnace and heated to a sintering temperature of about 1420 degrees centigrade. The compact was held at this sintering temperature for about 140 minutes and then the furnace was allowed to cool to room temperature. A near net-shape tantalum compact having a density of greater than 99.5 percent of theoretical was recovered.

Repetition of this process with a green pre-form having a density of approximately 40 volume percent of theoretical and slightly less metallic reagent will result in a reticulated porous compact with an average pore size of less than about 10 microns. Such porous compacts are suitable for use, for example, as filters in very harsh or sterile operating conditions, as lubricant saturated bearings, as biological filters, and the like.

Repetition of this process utilizing Au, Pd and Ru in the metallic reagent will produce satisfactory results.

Particularly satisfactory results will be achieved using metallic reagents composed of Pd and Ni or Pd and Co with W powder. Likewise, satisfactory results will be achieved using Cu-Ni metallic reagents with Ti powder.

The refractory metals to which the present invention is particularly applicable include, for example, the pure metals and alloys of rhenium (Re), tungsten (W), titanium (Ti), zirconium (Zr), vanadium (V), hafnium (Hf), tantalum (Ta), niobium (Nb), chromium (Cr), molybdenum (Mo), platinum (Pt), iridium (Ir), palladium (Pd), rhodium (Rh), and the like. These refractory metals are all capable of forming low temperature transient liquid phases with metals of limited solid solubility that are also capable of inducing activated sintering at concentration levels where they will ultimately substantially all diffuse into the refractory metals. Alloys of these refractory metals with one another and with other agents can be employed, if desired. Other mixtures of these refractory metals can be employed, if desired. Suitable refractory alloys include, for example, Ti—V—Al, Ti—Sn—Mo, Nb—Zr, Re—W, Re—W—Hf, and the like. For ease of description and definition, unless other wise indicated, the term "refractory metal" includes single metals and all such mixtures, and alloys are considered to be mixtures for purposes of this definition. To some extent, the solid solubility limits of the metallic reagents can be controlled by the judicious selection of alloying agents for the refractory metals based on previously published and generally available data for these systems.

The metallic reagents must be capable of cooperating with the refractory metals as described. Suitable metallic reagents for use with rhenium (Re) and its alloys include, for example, palladium (Pd), ruthenium (Ru), cobalt (Co), nickel (Ni), and alloys and other mixtures thereof, and the like. Suitable metallic reagents for use with Tungsten (W), chromium (Cr), molybdenum (MO), and their alloys include, for example, Palladium (Pd), nickel (Ni), Pd—Ni alloys, Pd—Co alloys, Cobalt (Co), silver (Ag), gold (Au), Au—Co, and Ru, alloys thereof, and the like. Suitable metallic reagents for use with titanium (Ti), zirconium (Zr), vanadium (V) and hafnium( Hf), and their alloys include, for example, copper (Cu), nickel (Ni), cobalt (Co), palladium (Pd), ruthenium (Ru), alloys and other mixtures thereof, and the like. Suitable metallic reagents for use with tantalum (Ta) and niobium (Nb) include, for example, gold (Au), silver (Ag), cobalt (Co), palladium (Pd), ruthenium (Ru), alloys and other mixtures thereof, and the like. Suitable metallic reagents for use with platinum (Pt), iridium (Ir), Palladium (Pd), and rhodium (Rh), include, for example, cobalt (Co), nickel (Ni), copper (Cu), gold (Au), silver (Ag), alloys and other mixtures thereof, and the like. For the purposes of description and definition, unless otherwise indicated, the term "metallic reagent" includes individual metallic reagents and all such mixtures, and alloys are considered to be mixtures for the purpose of this definition. Metallic reagents that are known to form low melting eutectics with the associated refractory metals are particularly preferred because the lowered processing temperatures minimize grain growth. In selecting metallic reagent-refractory metal systems the requirement that the processing temperatures be kept below about 80, and preferably 70, percent of the melting point of the refractory metal should be observed.

Solubilities of the metallic reagent in the refractory metal should be between about 10 and 0.1 volume percent. Above about 10 volume percent solubility, all of the metallic reagent dissolves into the refractory metal before the compact reaches substantially full density. Below about 0.1 volume percent, a matrix phase remains at the grain boundaries. Preferably, from about 0.5 to 3 volume percent of the metallic reagent should dissolve into the refractory metal at the operating temperatures that are applied.

The presence of finely divided inclusions, such as, for example, thoria, ceria, alumina, and the like, if desired, will strengthen the compacts. Substantially full density can be achieved with compacts including such inclusions, particularly where the particle sizes of the inclusions are approximately comparable to those of the other starting powders. Other inclusions and various shaped inclusions can be included, if desired.

What have been described are preferred embodiments in which modifications and changes may be made without departing from the spirit and scope of the accompanying claims. Clearly, many modifications and variations of the present invention are possible in light of the above teachings. It is therefore to be understood that, within the scope of the appended claims, the invention may be practiced otherwise than as specifically described.

What is claimed is:

1. A process for producing a substantially fully dense binder phase free refractory metal compact by low temperature transient liquid phase sintering and activated sintering, said process comprising:

selecting a refractory metal having a melting point;

selecting a metallic reagent, said metallic reagent being capable of cooperating with said refractory metal in carrying out said transient liquid phase sintering and said activated sintering, a limited amount of said metallic reagent being dissolvable in a solid phase of said refractory metal, said metallic reagent including at least two metals, a first of said metals being primarily effective in forming a low temperature transient liquid phase during said transient liquid phase sintering, and a second of said metals being primarily effective in activating said activated sintering;

forming a mixture of said refractory metal and an amount of said metallic reagent that is effective to form a transient liquid phase and is less than about said limited amount;

heating said mixture at a temperature that is less than approximately 80 percent of said melting point, allowing said transient liquid phase to form, and allowing a portion of said metallic reagent to dissolve in said refractory metal until said transient liquid phase substantially disappears and a solid body including at least one internal boundary and a metallic reagent residue at said boundary are formed;

heating said solid body at a temperature that is less than approximately 80 percent of said melting point, allowing said metallic reagent residue to activate said activated sintering, allowing substantially all of said metallic reagent residue to diffuse away from said internal boundary into said refractory metal to form a substantially binder phase free solid refractory metal, allowing said substantially binder phase free solid refractory metal to reach a density that is greater than about 98 percent of theoretical; and, recovering said substantially fully dense binder phase free solid refractory metal compact.

2. A process for producing a substantially binder phase free refractory metal compact by low temperature transient liquid phase sintering and activated sintering steps, said process comprising:

selecting a refractory metal powder having a melting point;

selecting a metallic reagent, said metallic reagent being capable of forming a transient liquid phase with said refractory metal and of activating said activated sintering, said metallic reagent having a solid solubility limit in said refractory metal, said metallic reagent including at least two metals, a first of said metals being primarily effective in forming said transient liquid phase, and a second of said metals being primarily effective in activating said activated sintering;

forming a mixture of said refractory metal powder and an amount of said metallic reagent sufficient to form said transient liquid phase but less than about enough to reach said solid solubility limit;

heating said mixture at a temperature that is no more than approximately 70 percent of said melting point, allowing said transient liquid phase to form and transient liquid sintering to occur, and allowing a portion of said metallic reagent to dissolve in said refractory metal until said transient liquid phase substantially disappears and a substantially solid body including at least one internal boundary and a metallic reagent residue at said boundary are formed;

heating said solid body at a temperature that is no more than approximately 70 percent of said melting point, allowing said metallic reagent residue to activate said activated sintering step, allowing substantially all of said metallic reagent residue to diffuse away from said internal boundary into said refractory metal to form a substantially binder phase free refractory metal; and, recovering said substantially binder phase free refractory metal compact.

3. A process for producing a substantially fully dense single phase refractory metal compact by transient liquid phase sintering and activated sintering steps, said process comprising:

selecting a refractory metal powder having a melting point;

selecting a metallic reagent, said metallic reagent being capable of forming a transient liquid phase with said refractory metal and of activating said activated sintering, said metallic reagent having a solid solubility limit in said refractory metal, said metallic reagent including at least two metals, a first of said metals being primarily effective in forming said transient liquid phase, and a second of said metals being primarily effective in activating said activated sintering;

forming a mixture of said refractory metal powder and an amount of said metallic reagent sufficient to form said transient liquid phase but less than about enough to reach said solid solubility limit;

heating said mixture at a temperature that is no more than approximately 80 percent of said melting point, allowing said solid body to reach a density that is greater than about 98 percent of theoretical, allowing substantially all of said metallic reagent to diffuse into said refractory metal; and, recovering said substantially fully dense single phase refractory metal compact.

4. A process for producing a substantially fully dense single phase refractory metal compact, said process comprising:

selecting a refractory metal powder having a melting point;

selecting a metallic reagent, said metallic reagent being capable of forming a transient liquid phase with said refractory metal and of activating an activated sintering phase of said refractory metal powder, said metallic reagent having a solid solubility limit in said refractory metal, said metallic reagent including at least two metals, a first of said metals being primarily effective in forming said transient liquid phase, and a second of said metals being primarily effective in activating said activated sintering;

forming a mixture of said refractory metal powder and enough of said metallic reagent to form said transient liquid phase, but no more than approximately enough to reach said solid solubility limit;

heating said mixture at a temperature that is no more than approximately 80 percent of said melting point, allowing said metallic reagent to form said transient liquid phase and to diffuse into said refractory metal at such a rate that said mixture solidifies, reaches a density that is greater than about 98 percent of theoretical, and substantially all of said metallic reagent diffuses into said refractory metal; and recovering said substantially fully dense single phase refractory metal compact.

5. A process for producing a substantially fully dense single phase refractory metal compact, said process comprising:

selecting a refractory metal, said refractory metal being in a powdered form and having a melting point;

selecting a metallic regent, said metallic reagent being capable of forming a liquid phase with said refractory metal and diffusing into said refractory metal, said forming and diffusing being capable of taking place at sintering temperatures that are no more than approximately 70 percent of said melting point, said metallic reagent including at least first and second metals, said first metal being primarily effective in forming said liquid phase, said diffusion of said second metal not being substantially complete until said refractory metal compact becomes substantially fully dense;

forming a mixture of said refractory metal and said metallic reagent, said mixture including sufficient metallic reagent to form said liquid phase and no more than approximately an amount of metallic reagent that will diffuse completely into said refractory metal at said sintering temperatures;

exposing said mixture to said sintering temperatures until said metallic reagent has substantially all diffused into said refractory metal; and recovering said substantially fully dense single phase refractory metal compact.

6. A process of claim 5 including selecting a refractory metal having a coating of said metallic reagent thereon.

7. A refractory metal compact composed of consolidated refractory metal grains, said compact having average grain size of less than about 50 microns, and said compact having substantially no binder phase between said consolidated refractory metal grains, said consolidated refractory metal grains comprise rhenium with from about 0.01 to 10 volume percent of a metallic reagent comprising cobalt and palladium diffused therein, said refractory metal compact having a density of greater than approximately 96 percent of theoretical, and said consolidated refractory metal grains having a contiguity of greater than about 96 percent.

* * * * *